US008487830B2

(12) United States Patent
Texier et al.

(10) Patent No.: US 8,487,830 B2
(45) Date of Patent: Jul. 16, 2013

(54) ANTENNA WITH LONG FOCAL LENGTH THAT IS COMPACT, ROBUST AND CAN BE TESTED ON THE GROUND, MOUNTED ON A SATELLITE

(75) Inventors: Emmanuel Texier, La Rouquette-sur-Siagne (FR); Eric Boban, Mandelieu (FR); Stéphane Ramin, Chateaudouble (FR); Thierry Longo, Mouane-Sartoux (FR)

(73) Assignee: Thales, Neuilly-sur-Seine (FR)

( * ) Notice: Subject to any disclaimer, the term of this patent is extended or adjusted under 35 U.S.C. 154(b) by 936 days.

(21) Appl. No.: 12/604,802

(22) Filed: Oct. 23, 2009

(65) Prior Publication Data

US 2010/0103073 A1 Apr. 29, 2010

(30) Foreign Application Priority Data

Oct. 24, 2008 (FR) ..... 08 05922

(51) Int. Cl.
*H01Q 15/20* (2006.01)

(52) U.S. Cl.
USPC ..... 343/881; 343/915; 343/DIG. 2

(58) Field of Classification Search
USPC ... 343/880, 881, 882, 915, DIG. 2; 244/172.6
See application file for complete search history.

(56) References Cited

U.S. PATENT DOCUMENTS

| | | | | |
|---|---|---|---|---|
| 5,257,034 | A | 10/1993 | Turner et al. | |
| 6,424,314 | B1 | 7/2002 | Baghdasarian et al. | |
| 6,669,147 | B2 | 12/2003 | Bertheux et al. | |
| 2007/0146227 | A1 * | 6/2007 | Brooks et al. | 343/881 |

FOREIGN PATENT DOCUMENTS

| | | | |
|---|---|---|---|
| EP | 0 704 373 | A2 | 4/1996 |
| GB | 2 127 624 | A | 4/1984 |
| WO | WO 2005/097595 | A1 | 10/2005 |

* cited by examiner

*Primary Examiner* — Robert Karacsony
(74) *Attorney, Agent, or Firm* — Baker & Hostetler LLP

(57) ABSTRACT

The invention proposes a solution to the problem of installing an antenna with long focal length on a satellite, and, as a non-limiting example, on satellites at a height that is less than the required focal length. It is based, on the one hand, on a reflector stored "inverted and head down", and, on the other hand, on a deployment movement sequence employing a long arm taken up in the top portion of the reflector via an articulation (1 axis) and a conventional deployment mechanism (1 or 2 axes).

9 Claims, 2 Drawing Sheets

ANTENNA WITH LONG FOCAL LENGTH THAT IS COMPACT, ROBUST AND CAN BE TESTED ON THE GROUND, MOUNTED ON A SATELLITE

CROSS-REFERENCE TO RELATED APPLICATIONS

This application claims priority of French application no. FR 08/05922, filed Oct. 24, 2008, the disclosure of which is hereby incorporated by reference in its entirety.

BACKGROUND OF THE INVENTION

1. Field of the Invention

The present invention relates to an antenna with long focal length that is compact, robust and can be tested on the ground, mounted on a satellite, and as a non-limiting example, on satellites at a height that is less than the focal length of the antenna.

2. Description of Related Art

Certain spacecraft, and telecommunication satellites in particular, must be furnished with antennae with long focal length (for example more than 3.5 m) which makes it possible to optimize their performance.

By their design, "simple offset" antennae with a large-diameter reflector (for example of at least 2 m) require a considerable focal length (more than or equal to 1.5 times the diameter of the reflector) in order to prevent problems of cross-polarization. The result of this is that, depending on the height of the platform carrying such an antenna, its integration onto this platform may be very difficult, which would make it necessary to choose a complex and heavy solution, and sometimes this integration may be impossible, making it necessary to choose another type of antenna that is heavier and more expensive.

In greater detail, the solutions of the prior art are as follows:

- Raising the height of the antenna source: requires a source-carrying structure that is heavy and expensive, and the field of vision of the source interferes with the platform and its appendices. Moreover, the face of the satellite facing the Earth is encumbered by the structure supporting the source, which limits the arrangement of the other antennae of the platform.
- Use of a deployment mechanism comprising three axes of which two deployment axes are placed on either side of the arm of the antenna reflector (one on the side of the platform and one on the side of the reflector). In this solution, the arm and the fittings are specific and complex, the reflector turns over (cannot be tested on the ground) during its deployment.
- Gregorian antenna: it has considerable weight and cost because it requires two reflectors and dedicated structures for supporting the source and the secondary reflector; the heat control of the source is critical because this source is encased in order to limit the space requirement towards the outside of the satellite, and the face turned towards the Earth is encumbered by the structure carrying the secondary reflector, which limits the arrangement possibilities of the other antennae.
- Two-grid antenna: this type of antenna has the advantage of not requiring much focal length—its focal length/diameter ratio is of the order of 1—and it is therefore possible to manage to arrange considerable diameters on platforms of reduced height. However, the space requirement in the stored configuration, due to the height of the peripheral stiffener between its two shells, poses compatibility problems with the nose cones of standard-sized launch vehicles.

SUMMARY OF THE INVENTION

One embodiment of the present invention is an antenna with long focal length that is compact, robust and can be tested on the ground, mounted on a satellite, and, as a non-limiting example, on satellites at a height that is less than the focal length of the antenna, this antenna being lighter, more robust and less expensive than the existing solutions, easy to test and not interfering with the other equipment of the carrying satellite, whether it be in the stored position or in the deployed position of the antenna.

The antenna according to the invention is characterized in that it comprises a reflector which, in the stored position of the antenna, has its active face oriented away from the supporting structure of the antenna, the stem for connecting the reflector with the deployment arm then being directed towards the top of the supporting structure, the articulation of this stem with the arm having a degree of rotational freedom, the arm for deployment of the reflector being connected to the carrying structure of the antenna via an articulation having at least one degree of rotational freedom attached to this structure, this arm being positioned between the reflector and the structure in the stored position of the antenna, the reflector then being pressed against this structure.

The concepts of "top" and "bottom" of the elements in question relate in this instance to elements used on board a satellite travelling in space, the "top" being the portion of these elements facing the Earth.

BRIEF DESCRIPTION OF THE DRAWINGS

The present invention will be better understood on reading the detailed description of an embodiment, taken as a non-limiting example and illustrated by the appended drawing in which.

DETAILED DESCRIPTION OF THE INVENTION

Figure 1:
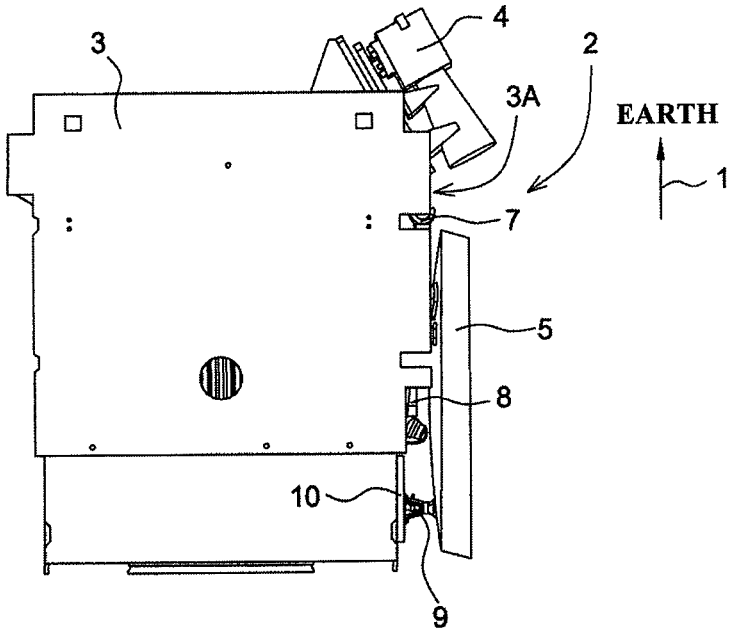
FIGS. 1 to 3 are schematic views in profile of one embodiment of the arrangement of the antenna according to the invention in various phases of deployment.
Figure 2:
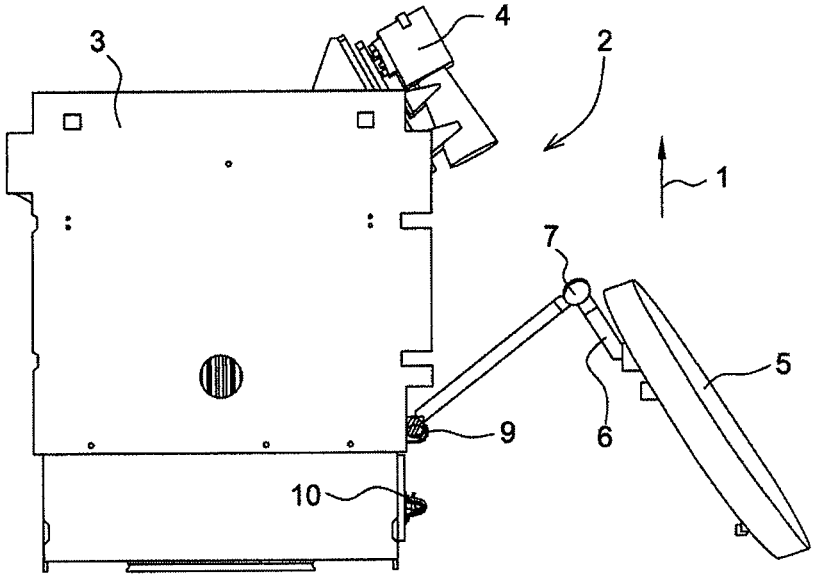
Figure 3:
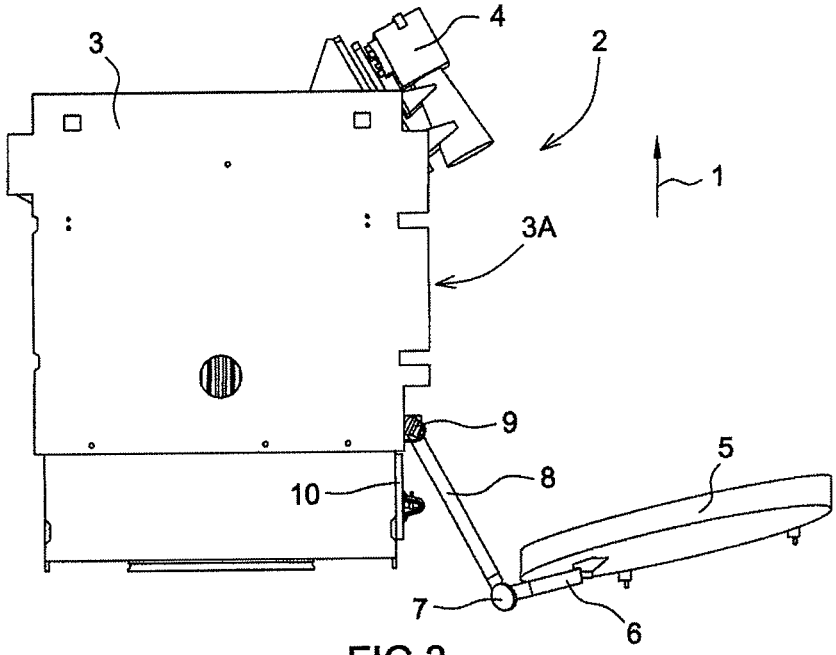
Figure 4:
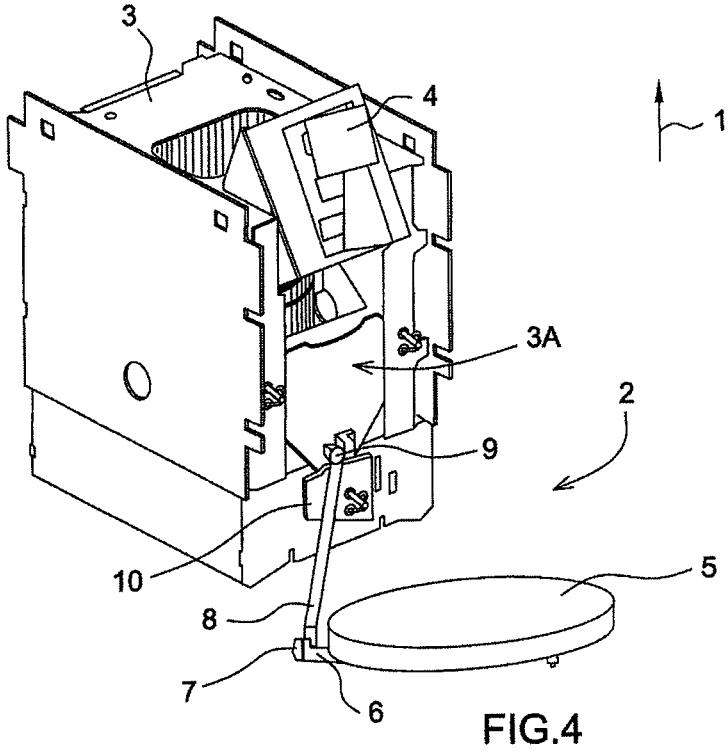
FIG. 4 is a three-quarter view in perspective of the configuration of FIG. 3.

The drawing figures depict elements of the antenna of the invention and of its supporting structure that are necessary to the understanding of the invention. The arrow 1, directed towards the top of the drawing, indicates the direction of the Earth, the carrying satellite being assumed to be in space. FIGS. 1 to 3 correspond respectively to the stored state, an intermediate state of deployment of the antenna and the deployed state of the antenna, FIG. 4 being a view in perspective of the configuration of FIG. 3, as specified above.

The antenna 2 of the invention is attached to the lateral face 3A of a supporting structure 3 supporting other devices not shown. The source 4 of the antenna is attached to the upper portion of the structure 3. The paraboloid reflector 5 of the antenna comprises, on its rear face, a radial attachment stem 6 secured to the rear face of the reflector (shell and/or any other rear structure). The stem 6 is connected via a motorized articulation 7 (motorized with the aid of a leaf spring or a stepper motor) with a degree of rotational freedom at one end of the arm 8 itself for deployment of the reflector. The other end of the arm 8 is connected via an articulation 9 to a secondary support or carrying structure 10, itself attached to the structure 3. The articulation 9 has at least one degree of rotational freedom. As a variant, the articulation 9 is motorized and comprises one or two electric stepper motors, or else a leaf spring (for only one degree of rotational freedom).

As shown in FIG. 1, in the stored state (antenna not yet in service), the arm 8 is folded and is substantially parallel to the face 3A of the structure 3, the articulation 7 being pressed against the upper portion of the face 3A. The stem 6 and the reflector 5 are also pressed against this face 3A. In this position, the reflector 5 practically does not protrude beyond the sides of the face 3A. In a stored position of the antenna, the reflector has an active face that is oriented away from a supporting structure of the antenna.

As shown in FIG. 2, during the intermediate phase of deployment of the antenna 2, the motorization—provided by a spring (mechanical) or by a stepper motor (electrical)—of the articulation 9 moves the arm 8 away from the face 3A, while that of the articulation 7 turns the stem 6 which turns about the axis of the articulation 7 (in FIG. 2, the stem 6 is represented after having rotated approximately 90°). The stem 6 turns from its folded position (FIG. 1) to the position of normal use of the reflector 5 (see FIGS. 3 and 4) through an angle of approximately 280°, while the arm 8 makes a rotation of approximately 170°. For this position of normal use of the reflector 5, the latter is oriented towards the Earth, while naturally being positioned correctly relative to the source 4. In a normal position of use of the reflector, one of the two axes of rotation of the articulation 9 is perpendicular to an arrangement face of the antenna. The rotations of the arm 8 and of the stem 6 may be synchronized, sequenced or simultaneous.

What is claimed is:

1. An antenna with long focal length, that is compact, robust and can be tested on the ground, and mounted on a satellite, comprising:

a reflector which, in a stored position of the antenna, has an active face oriented away from a supporting structure of the antenna; and a stem for connecting the reflector with an arm for deployment of the reflector, in the stored position of the antenna the stem is directed towards a top of the supporting structure, an articulation of the stem with the deployment arm having a degree of rotational freedom, the deployment arm being connected to a carrying structure of the antenna via an articulation having at least one degree of rotational freedom attached to the supporting structure, the deployment arm being positioned between the reflector and the supporting structure in the stored position of the antenna, the reflector being pressed against the supporting structure in the stored position.

2. The antenna with long focal length on the satellite according to claim 1, wherein the articulation between the stem for connecting the reflector with the arm for deployment of the reflector is motorized by a leaf spring.

3. The antenna with long focal length on the satellite according to claim 1, wherein the articulation between the stem for connecting the reflector with the arm for deployment of the reflector is motorized by an electric stepper motor.

4. The antenna with long focal length on the satellite according to claim 1, wherein the articulation connecting the arm for deployment of the reflector to the carrying structure of the antenna has a degree of rotational freedom.

5. The antenna with long focal length on the satellite according to claim 4, wherein the articulation is motorized by a leaf spring.

6. The antenna with long focal length on the satellite according to claim 4, wherein the articulation is motorized by an electric stepper motor.

7. The antenna with long focal length on the satellite according to claim 1, wherein the articulation connecting the arm for deployment of the reflector to the carrying structure of the antenna has two degrees of rotational freedom.

8. The antenna with long focal length on the satellite according to claim 7, wherein the articulation is motorized by two electric stepper motors.

9. The antenna with long focal length on the satellite according to claim 8, wherein, in a normal position of use of the reflector, one of the two axes of rotation is perpendicular to an arrangement face of the antenna.

* * * * *